US005767862A

United States Patent [19]

Krishnamurthy et al.

[11] Patent Number: 5,767,862

[45] Date of Patent: Jun. 16, 1998

[54] METHOD AND APPARATUS FOR SELF-THROTTLING VIDEO FIFO

[75] Inventors: Subramanian Krishnamurthy, Mountain View, Calif.; James Peterson, Portland, Oreg.; Paul Shupak, San Jose, Calif.

[73] Assignee: Rendition, Inc., Sunnyvale, Calif.

[21] Appl. No.: 616,546

[22] Filed: Mar. 15, 1996

[51] Int. Cl.[6] ..... G09G 5/00

[52] U.S. Cl. ..... 345/507

[58] Field of Search ..... 345/27, 28, 507, 345/509, 515, 516, 508, 203, 213; 365/221, 78; 395/250, 486, 436, 728

[56] References Cited

U.S. PATENT DOCUMENTS

| | | | |
|---|---|---|---|
| 4,942,553 | 7/1990 | Dalrymple et al. | 395/877 |
| 5,027,330 | 6/1991 | Miller | 365/78 |
| 5,084,841 | 1/1992 | Williams et al. | 365/221 |
| 5,155,830 | 10/1992 | Kurashige | 395/844 |
| 5,214,607 | 5/1993 | Duzan | 365/221 |
| 5,369,617 | 11/1994 | Munson | 365/219 |
| 5,379,399 | 1/1995 | Conway-Jones et al. | 711/109 |
| 5,406,306 | 4/1995 | Siann et al. | 345/115 |
| 5,426,756 | 6/1995 | Shyi et al. | 711/159 |
| 5,471,583 | 11/1995 | Au et al. | 395/877 |
| 5,530,458 | 6/1996 | Wakasu | 345/507 |
| 5,592,629 | 1/1997 | Gamble | 395/871 |
| 5,617,118 | 4/1997 | Thompson | 345/516 |
| 5,623,634 | 4/1997 | Liu | 395/728 |

*Primary Examiner*—Steven J. Saras
*Assistant Examiner*—Paul A. Bell
*Attorney, Agent, or Firm*—Blakely, Sokoloff, Taylor & Zafman LLP

[57] ABSTRACT

A method and an apparatus for writing display data to and reading display data from a FIFO. In one embodiment of the present invention, a memory controller coupled to a memory is configured to retrieve display data from the memory and write the retrieved data to a FIFO. The memory controller retrieves the display data from the memory in response to a FIFO write signal received from an output display controller. The output display controller is further configured to generate a FIFO read signal which is received by the FIFO. In response to the FIFO read signal, display data entries are sequentially read from the FIFO and transferred to an output display. The present invention features a programmable memory circuit such as a register, configured to store the value pointing to a particular display data entry in the FIFO. When the particular display data entry is read, a subsequent FIFO write signal is issued to the memory controller. The value stored in the programmable memory circuit is chosen to minimize the occurrences of overflow and underflow conditions in the FIFO. In addition, the present invention features a self-adjusting, or self-throttling aspect which provides the present invention with the capability to dynamically adapt to different computer system configurations having different system clock and video clock frequencies.

27 Claims, 3 Drawing Sheets

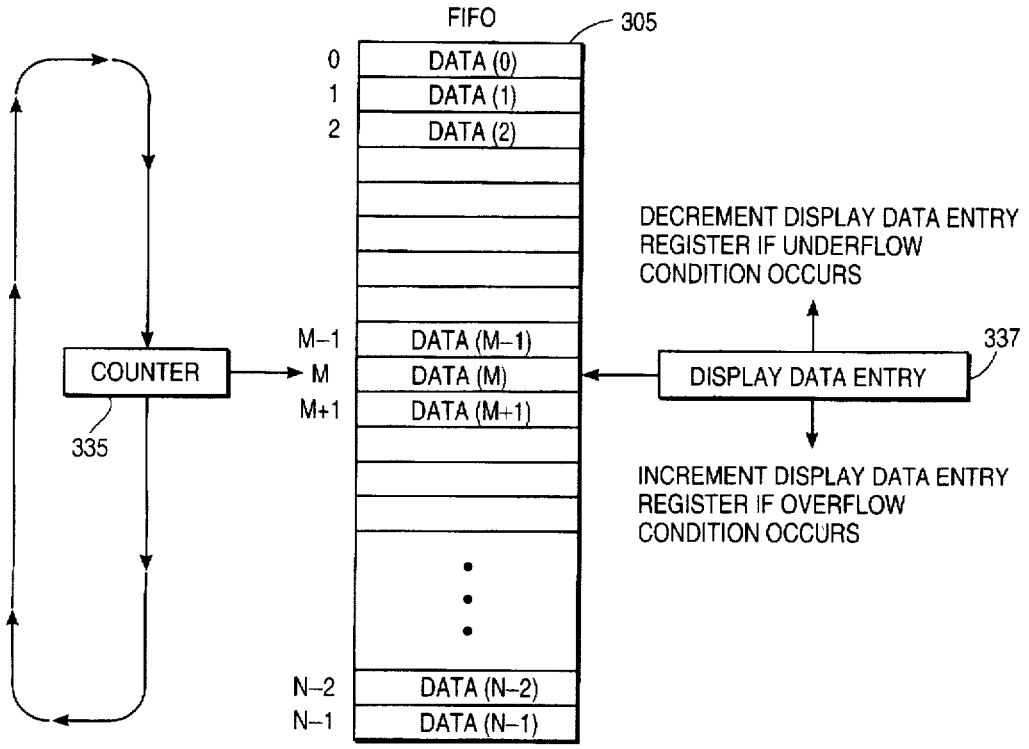

FIG_3

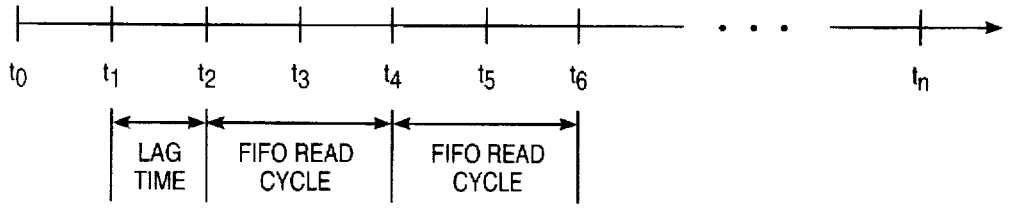

$t_0$ : DISPLAY DATA WRITTEN TO MEMORY.

$t_1$ : FIFO WRITE SIGNAL ISSUED; DISPLAY DATA ENTRIES WRITTEN TO FIFO FROM MEMORY.

$t_2$ : FIRST DISPLAY DATA ENTRY ASSOCIATED WITH $t_1$ FIFO WRITE SIGNAL READ FROM FIFO.

$t_3$ : DISPLAY DATA ENTRY POINTED TO BY DISPLAY DATA ENTRY REGISTER READ FROM FIFO, FIFO WRITE SIGNAL ISSUED.

$t_4$ : FIRST DISPLAY DATA ENTRY ASSOCIATED WITH $t_3$ FIFO WRITE SIGNAL READ FROM FIFO.

$t_5$ : DISPLAY DATA ENTREY POINTED TO BY DISPLAY DATA ENTRY REGISTER READ FROM FIFO, FIFO WRITE SIGNAL ISSUED.

$t_6$ : FIRST DISPLAY DATA ENTRY ASSOCIATED WITH $t_5$ FIFO WRITE SIGNAL READ FROM FIFO.

$t_7$ : ALL DISPLAY DATA OUTPUT TO OUTPUT DISPLAY.

FIG_4

METHOD AND APPARATUS FOR SELF-THROTTLING VIDEO FIFO

FIELD OF THE INVENTION

The present invention relates generally to computer systems and more specifically, the present invention relates to graphics computer systems.

BACKGROUND OF THE INVENTION

Personal computers, work station computers and the like generate graphics and video on output displays such as cathode ray tubes (CRTs) and monitors. In recent years, the output displays of these computer systems have become increasingly advanced and flexible. There is a trend in the computer industry for more complex graphics, more colors, as well as varying resolutions being generated on output displays. Accordingly, graphics computer system designers have had to design the associated computer graphics hardware to meet these design demands.

FIG. 1 shows a portion of computer graphics hardware commonly found in modern computer systems supporting graphics displays. As shown in FIG. 1, a prior art computer system 101 is shown with memory controller 103 coupled to receive display data 113 from a display memory (not shown). The display data 113 received by memory controller 103 is thereafter transferred to first-in-first-out memory (FIFO) 105. After display data 113 entries are written into FIFO 105, a FIFO read cycle may begin where the display data 113 entries in FIFO 105 are sequentially read from FIFO 105 and then transferred to output display 115. The transfer of display data 113 entries from the display memory to the output display 115 is controlled by output display controller 107 as shown in FIG. 1. Output display controller 107 generates a FIFO write signal 109 to memory controller 103. A FIFO write signal 109 is a request from the output display controller which causes memory controller 103 to fetch the display data 113 from the display memory and subsequently load the display data 113 into FIFO 105. As shown in FIG. 1, memory controller 103 is clocked with system clock 117. As further shown in FIG. 1, the display data 113 is output to output display 115 in response to a series of FIFO read signals 111 generated by the output display controller 107. A FIFO read signal 111 is a request by the output display controller 107 which causes a display data 113 entry to be transferred out of FIFO 105 to output display 115 under control of video clock 119.

It is appreciated that in prior art computer system 101, system clock 117 and video clock 119 generally have different clock frequencies. More significantly, display data 113 is written into FIFO 105 at a different rate than the display data 113 is subsequently read, or consumed, by output display 115. As a result, computer system designers face the potential problem of FIFO 105 becoming full. When the FIFO 105 becomes full, new display data 113 entries may be written over existing display data 113 entries before output display 115 has had the opportunity to read the over-written display data 113 entry in FIFO 105. This condition is commonly referred to as an overflow condition. A consequence of this condition is that some display data 113 entries may be lost or not written properly to the output display 115.

One requirement of computer systems such as prior art computer system 101 is that display data 113 must be continuously transferred to output display 115. Thus, FIFO 105 must never become empty. Since there is some lag time between the issuance of a FIFO write signal 109 to memory controller 103 and when the associated display data 113 entries are ready to be read in FIFO 105, FIFO write signal 109 must be issued some time in advance before a FIFO read cycle has been completed to ensure that FIFO 105 never becomes empty.

It is also noted that if output display controller 107 of prior art computer system 101 does not wait for a sufficient amount of time for memory controller 103 to reload new display data 113 entries into FIFO 105, an underflow condition would occur. That is, if output display controller 107 prematurely issues a FIFO read signal 111 to FIFO 105 when FIFO 105 is empty, an underflow condition would occur resulting in erroneous display data 113 being written to output display 115. Naturally, this condition is also unacceptable. In sum, FIFO 105 must never become empty or full.

It is appreciated that it is extremely difficult for designers to predict in advance an optimum time for exactly when a FIFO write signal 109 should be issued to the memory controller 103 to begin reloading FIFO 105 during a FIFO read cycle. As mentioned above, if FIFO 105 is designed to be disproportionately large to avoid overflow conditions, circuit designers are able to have output display controller 107 issue such FIFO write signals 109 to reload FIFO 105 very early in a FIFO read cycle. If the FIFO write signal 109 is issued too late in the FIFO read cycle, then the FIFO 105 could empty before new display data 113 entries are written to FIFO 105, causing unwanted underflow conditions.

The problems with predicting an optimal time for when output display controller 107 to issue FIFO write signals 109 is further exacerbated in situations where system clock 117 and/or video clock 119 are unknown. It is noted that computer system designers are often unable to predetermine the clock frequencies of system clock 117 and video clock 119.

Furthermore, it is difficult for software running on a computer to ascertain the system clock 117 and video clock 119 frequencies. As a result, the rates at which display data 113 entries are written into and read from FIFO 105 are unknown. Thus, in order to accommodate worst case scenarios, graphics computer system designers have had to implement very large FIFOs 105 resulting in an unacceptable sacrifice of substrate area and cost to avoid overflow and underflow conditions.

Another prior art solution computer designers use to address the problems presented above is to implement a large FIFO 105 with many entries in order to accommodate large amounts of display data 113. In theory, if FIFO 105 is infinitely large, an overflow condition would never occur. Furthermore, output display controller 107 would be able to issue FIFO write signals 109 in good time before output display 115 has consumed all existing valid display data 113 entries in FIFO 105. Therefore, an underflow condition is also avoided. Thus, this prior art solution addresses the overflow and underflow problems associated with prior art computer system 101. An obvious consequence of this prior art design is that FIFO 105 must be designed unnecessarily large.

Therefore, what is needed is a FIFO which can transfer display data entries from a memory to an output display which suffers from minimal overflow and underflow conditions. In addition, the FIFO should not be disproportionately large and unnecessarily sacrifice valuable substrate area and expense. Moreover, such a FIFO should be able to accommodate and adapt to unknown combinations of system clock and video clock frequencies. The FIFO would effectively minimize the occurrences of overflow and underflow conditions and could be used in a wide variety of modern graphics computer systems.

SUMMARY OF THE INVENTION

A method and an apparatus for writing display data to and read display data from a FIFO is disclosed. In one embodiment, a memory controller configured to receive and supply display data is coupled to the FIFO. An output display controller configured to generate FIFO write signals to the memory controller is coupled to the FIFO such that the memory controller writes a portion of the display data to the FIFO in response to the FIFO write signal. Afterwards, display data entries of the portion of the display data in the FIFO are sequentially read from the FIFO in response to a FIFO read signal generated by the output display controller. A programmable register is configured to store a value corresponding with a particular display data entry in the FIFO. When that particular display data entry is read from the FIFO, the output display controller generates another FIFO write signal to the memory controller to load another portion of the display data into the FIFO. Additional features and benefits of the present invention will become apparent from the detailed description, figures and claims set forth below. Other features and advantages of the present invention will be apparent from the accompanying drawings and from the detailed description which follows below.

BRIEF DESCRIPTION OF THE DRAWINGS

The present invention is illustrated by way of example and not limitation in the accompanying figures.

FIG. 3 is an illustration of the present FIFO in relation to the present counter register and display data entry register.

FIG. 4 is an illustration of a timeline representing the occurrence of particular events in accordance with the teachings of the present invention.

DETAILED DESCRIPTION

A method and an apparatus for writing display data to and reading display data from a FIFO is disclosed. In the following description, numerous specific details are set forth such as clock frequencies, memory sizes, consumption rates, etc. in order to provide a thorough understanding of the present invention. It will be obvious, however, to one having ordinary skill in the art that the specific details need not be employed to practice the present invention. In other instances, well known materials or methods have not been described in details in order to avoid unnecessarily obscuring the present invention.

The present invention provides an innovative solution to the video FIFO overflow and underflow problems using a reasonably sized video FIFO. The present invention incorporates a self-adjusting, or self-throttling, video FIFO which coordinates the timing of FIFO read signals in relation to FIFO write signals such that the occurrence of FIFO overflow and/or FIFO underflow conditions are minimized after an initialization period.

Figure 1:
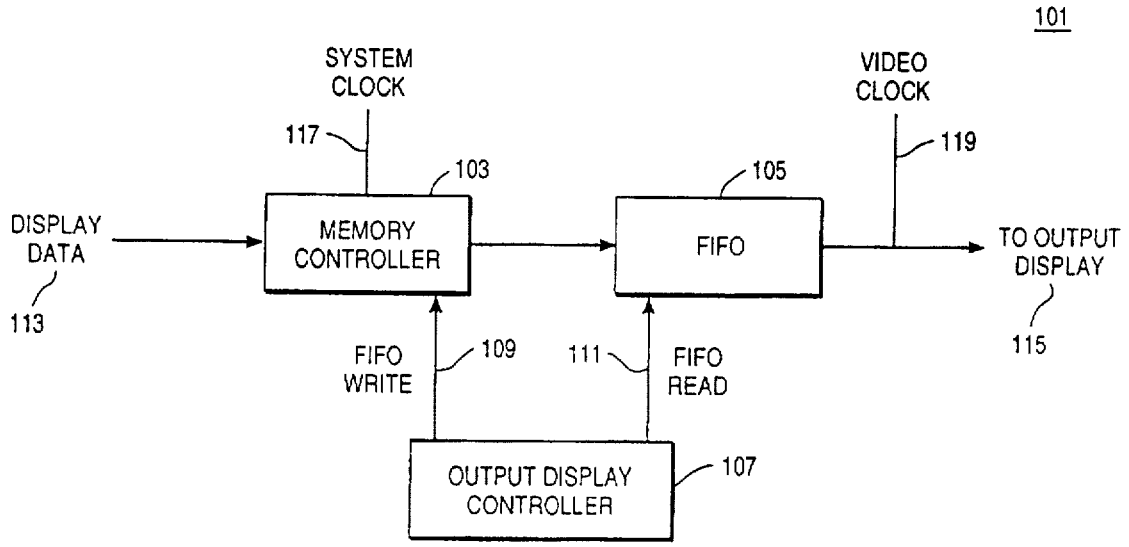
FIG 1 (PRIOR ART)
FIG. 1 illustrates a portion of a prior art computer system including a prior art FIFO.
Figure 2:
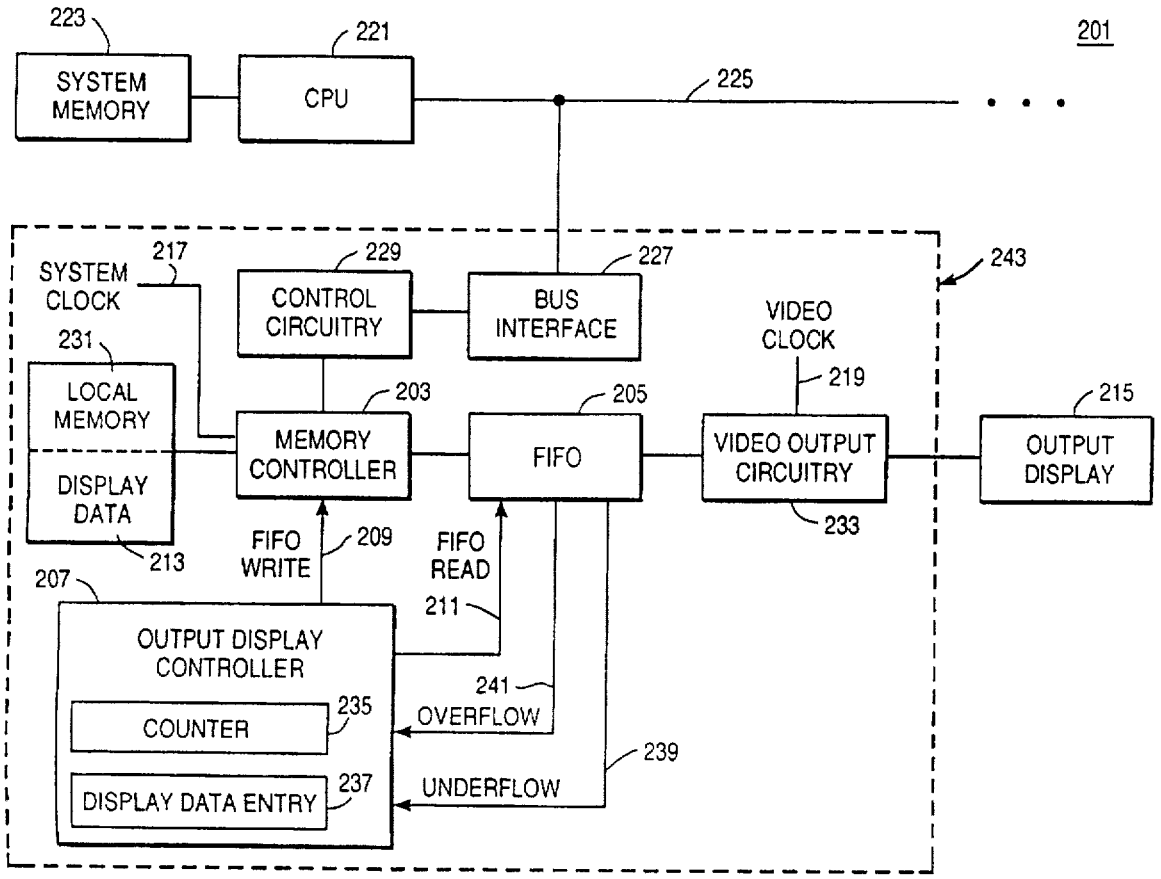
FIG. 2 illustrates in block diagram for the present invention implemented in a computer system.

FIG. 2 illustrates in block diagram form the present invention implemented in a computer system 201. As shown in FIG. 2, computer system 201 is a general purpose computer including a central processing unit (CPU) 221 coupled to system memory 223 and a bus 225. Graphics subsystem 243 is coupled to bus 225 is. In one embodiment of the present invention, bus 225 is a PCI bus. It is noted that other types of busses may be used so long as CPU 221 is in communication with graphics subsystem 243.

In the embodiment shown in FIG. 2, graphics subsystem 243 is coupled to bus 225 through bus interface 227. Control circuitry 229 is coupled to bus interface 227 and controls memory controller 203. Local memory 231, which includes display data 213 is coupled to memory controller 203. Display data 213 is display information which is ultimately transferred to output display 215. It is appreciated that display data 213 may be comprised of a number of display data entries representing video data or graphics information. Memory controller 203 is coupled to video FIFO 205. Memory controller 203 and video FIFO 205 are coupled to output display controller 207. As shown in FIG. 2, memory controller 203 receives a FIFO write signal 205 and FIFO 205 receives FIFO read signal 211 from output controller 207. An output of FIFO 205 is coupled to video output circuitry 233 which is coupled to output display 215. As shown in FIG. 2, memory controller 203 is clocked with system clock 217 and video output circuitry is clocked with video clock 219.

Output display controller 207 includes counter register 235 and display data entry register 237. In addition, output display controller 207 is coupled to receive underflow signal 239 and overflow signal from FIFO 205. When an underflow condition occurs in FIFO 205, output display controller 207 is notified via underflow signal 239. When an overflow condition occurs in FIFO 205, output display controller 207 is notified via overflow signal 241.

In one embodiment of the present invention, with the exception of local memory 231, all elements of graphics subsystem 243 exist on the same substrate. In that embodiment, control circuitry 229 includes a reduced instruction set computer (RISC) processor as well as supporting circuitry such as an instruction cache and VGA compatible circuitry.

The present invention takes into consideration the fact that output displays, such as CRTs and monitors, have different output modes. For instance, there are different output resolutions for output displays. The different display resolutions effect the video consumption rate or video output rate from FIFO 205. That is, the frequency of video clock 219 may depend on the particular resolution of output display 215. Furthermore, many computer systems have variable output resolutions such that the output resolution of output display 215 may be altered at any time, thus altering the frequency of video clock 219 at any time. For example, in one embodiment, video clock 219 may have a frequency of 31 megahertz when output display 215 is set to have a resolution of 640 by 480 by 16. In another instance, video clock 219 may have a frequency of 78 megahertz when output display 215 is set to have a resolution of 1,024 by 768 by 16. Accordingly, the rate at which video information, or display data, is read from FIFO 205 is effected by the output resolution.

In addition, as discussed above, the rate at which memory controller 203 writes video information or display data to FIFO 205 is in relation to system clock 217. It is appreciated that computer system designers often do not know beforehand the frequency of system clock 217. This circumstance may be explained by the fact that graphics subsystems 243 may be incorporated in a variety of different computer systems 201 having different clock frequencies for system clock 217. Furthermore, one embodiment of present graphics subsystem 243 may be operated at different frequencies resulting in a variety of clock frequency configurations for system clock 217.

The overall effect of having unknown combinations of system clock 217 and video clock 219 frequencies is that it is extremely difficult if not impossible for computer system designers to coordinate precisely the issuances of FIFO write signals 209 and FIFO read signals 211 to avoid overflow and underflow conditions in FIFO 205. The present invention provides a solution to this problem by using display data entry register 237.

Operation of the present invention with display data entry register 237 and FIFO 205 is as follows. As shown in FIG. 3, FIFO 305 is a memory having N entries 0 through N−1. Each entry in FIFO 305 is configured to store a display data entry as indicated by DATA(0) through DATA(N−1). In one embodiment of the present invention, FIFO 305 is a 16 entry by 8 byte memory which stores 1,024 bits of information. In that embodiment, 32 bits of information are read at a time and output to the video output circuitry 223. Accordingly, assuming FIFO 305 is filled with display data entries, 1,024÷32, or 32 separate FIFO read signals 211 are required for one FIFO read cycle to read the entire FIFO 305. Therefore, since there are 32 entries in FIFO 305, N=32 in that embodiment. If, for instance, 64 bits of information could be read per access of FIFO 305, then FIFO 305 would contain 1,024÷64, or 16 entries, and N would therefore be equal to 16 in that embodiment.

Referring back now to FIG. 2, assume that display data 213 has already been written to local memory 231. Afterwards, output display controller 207 issues a FIFO write signal 209 to memory controller 203 to load FIFO 205. In response, memory controller 203 obtains a portion of display data 213, or 1,024 bits of display data, and loads that data into FIFO 205. Assuming that FIFO 205 is a 16 entry by 8 byte FIFO and that 32 bits of information are read per clock, FIFO 205 contains 32 entries as shown in FIFO 305 of FIG. 3. Memory controller 203 writes DATA(0) through DATA(N−1) into FIFO 205 at a rate controlled by system clock 217. Afterwards, output display controller 207 begins sequentially transferring the display data 213 entries in FIFO 205 to output display 215 through video output circuitry 233. To do so, output display controller 207 issues a series of FIFO read signals 211 to FIFO 205. Referring back now to FIG. 3, the display data 213 entry in DATA(0) is first read from FIFO 305 and then transferred to output display 215 through video output circuitry 233. Afterwards, output display controller 207 issues a subsequent FIFO read signal 211 to FIFO 205 and DATA(1) is then read from FIFO 305 and output to output display 215 through video output circuitry 233. As shown in FIG. 3, display data entry register 337 contains a value which points to a particular entry in FIFO 305. In the example shown in FIG. 3, display data entry 337 points to the Mth entry in FIFO 305, or DATA(M). When DATA(M) is read from FIFO 305 in response to a FIFO read signal 211, output display controller 207 issues another FIFO write signal 209 to memory controller 203 to begin refilling FIFO 305 with the next portion of display data 213 to transfer to output display 215.

In the present invention, display data entry register 337 is a programmable register programmed to contain a value pointing to a particular display data 213 entry in FIFO 305. When that particular display data 213 entry is read from FIFO 305, a subsequent FIFO write signal 209 is issued to memory controller 203. The particular display data 213 entry programmed into display data entry register 337 is chosen such that the occurrence of overflow and underflow conditions in FIFO 305 is minimized. That is, the value programmed into display data entry register 337 is chosen such that a subsequent FIFO write signal 209 is issued early enough in a FIFO read cycle such that an underflow condition is avoided. In addition, the entry chosen for display data entry register 337 is chosen such that a subsequent FIFO write signal 209 is issued late enough in a FIFO read cycle such that a sufficient number of memory locations are freed in FIFO 305 in order to avoid an overflow condition occurring.

An underflow condition is when a FIFO read signal 211 is issued to FIFO 305 when no new data exists in FIFO 305 to be transferred to the output display. An overflow condition occurs when memory controller 203 writes to FIFO 305 when FIFO is full of display data 213 entries which have not yet been read.

In one embodiment of the present invention, counter register 335 points to the particular display data 213 entry being read from FIFO 305 at any particular time. So, for instance, counter 335 may be equal to zero and point to the first entry in FIFO 305 at the beginning of a particular FIFO read cycle. After that particular entry is read, counter 335 is incremented to equal the next value. Thus, in this example, counter 335 would equal 1. After counter 335 reaches the last entry in FIFO 305, counter 335 is "rolled over" backed to the first entry in FIFO 305, as shown in FIG. 3.

In one embodiment of the present invention, the value contained in counter register 335 is compared to the value contained in display data entry register 337. When counter 335 and display data entry register 337 are equal, a FIFO write signal 209 is issued. In FIG. 3, display data entry register 337 is shown pointing to the Mth entry in FIFO 305 and counter 335 is also shown pointing to the Mth register in FIFO 305. Thus, in accordance with the present invention, a FIFO write signal 209 would be issued to the memory controller 203.

Accordingly, assuming that the value programmed into display data entry register 337 is a proper value, underflow and overflow conditions may be avoided in FIFO 205 in computer systems having unknown clock frequencies for system clock 217 and video clock 219. A further benefit of the present invention is that FIFO 205 or 305 need not be excessively large to avoid underflow and overflow conditions. Thus, unnecessary cost and substrate area need not be sacrificed.

Another innovative aspect of the present invention can be appreciated with the utilization of an underflow signal 239 and an overflow signal 241 as shown in FIG. 2. With underflow signal 239 and overflow signal 241, the present invention features self-adjusting or self-throttling capabilities. With such self-throttling capability, the particular value programmed into display data entry register 337 can be dynamically updated to accommodate any particular combination of clock frequencies in system clock 217 and video clock 219 at any time. So, the value in display data entry register 337 is dynamically adjusted for any particular combination of clock frequencies to ensure an ideal value to be programmed into display data entry register 337 to minimize the occurrence of overflow and underflow conditions in FIFO 205.

The self-throttling nature of the present invention is as follows. Continuing with the example presented above, assume now that the value contained in display data entry register 337 has not yet been optimized. Such a condition may be the case at system start up, system reset or the like. Assume now that display data 213 entries have been written into FIFO 305 of FIG. 3 and that subsequent FIFO read signals 211 have been issued. When the value contained in counter 335 is equal to the value contained in display data entry register 337, a FIFO write signal 209 is issued to memory controller 203 of FIG. 2.

Assume now that an overflow condition occurs as memory controller 203 begins to fill FIFO 305 with the next portion of display data 213 from local memory 231. That is, memory controller 203 attempts to "push" data onto FIFO 205 when FIFO 205 is "full." In response, FIFO 205 generates an overflow 241 signal received by output controller 207. In response to the receipt of the overflow 241 signal, the value in display data entry register 337 is incremented as shown in FIG. 3. Accordingly, the next FIFO write signal 209 will be issued "later" in the FIFO read cycle. That is, if display data entry register 337 previously pointed to DATA(M), display data entry register 337 will point to DATA(M+1) after it has been incremented in response to the overflow 241 signal. As a result, more data entries in FIFO 305 will be read and freed in the next FIFO read cycle before a subsequent FIFO write signal 209 is issued to memory controller 203.

Display data entry register 337 is incremented for each overflow signal received from FIFO 205. Eventually, display data entry register 337 will be optimized such that a sufficient number of memory locations in FIFO 305 has been read and freed before a subsequent FIFO write signal 209 is issued to avoid overflow conditions in FIFO 205.

Similarly, assuming that a FIFO write signal is issued too late in a FIFO read cycle, a FIFO read signal 211 may be issued to FIFO 305 before memory controller 203 has had the opportunity to write any display data to FIFO 305. This may occur as a result of lag time between the time at which FIFO write signal 209 is issued to memory controller 203 and the time at which display data 213 entries are actually written into FIFO 305. As a result, an underflow condition would occur in FIFO 205 and an underflow signal 239 would be issued by FIFO 205 to output display controller 207.

In response to the receipt of the underflow signal 239, the value in display data entry register 337 would therefore be decremented. Thus, if display data entry register 337 were pointing to DATA(M), as shown in FIG. 3, display data entry register 337 would then be pointing to DATA(M−1) after the occurrence of the underflow condition in FIFO 205. This would cause the next FIFO write signal 209 to be issued earlier in the subsequent FIFO read cycle. Display data entry register 337 would be decremented for each occurrence of underflow signal 241 until display data entry register 337 had been properly adjusted.

It is noted that a number of overflow or underflow conditions may occur in the present invention before the value in display data entry register 337 is optimized. However, in one embodiment of the present invention, optimization of the value in display data entry register 337 occurs so quickly that a user of computer system 201 is unable to discern errors produced on output display 215. In other words, the present invention settles very quickly such that the user would not notice any errors on the screen. Accordingly, it is noted that the initial value contained in display data entry register 337 at system start-up or system reset is insignificant due to the rather quick settling time of the present invention. In one embodiment of the present invention, display data entry register 337 is initially set to "0" at system reset.

A timeline illustrating some of the events occurring in the present invention is shown in FIG. 4 as timeline 401. Time progresses from left to right in timeline 401. At $t_0$, display data 213 is written into the local memory 231 of graphics subsystem 243.

At $t_1$, a FIFO write signal 209 is issued by the output display controller 207 to memory controller 203 to retrieve a portion of the display data 213 previously written into local memory 231. Memory controller 203 obtains the portion of display data from local memory 231 at a rate controlled by system clock 217. The display data 213 entries of the obtained portion of display data are then written into FIFO 205.

At $t_2$, the first display data 213 entry associated with the FIFO write signal 209 of $t_1$ is read from FIFO 205.

At $t_3$, the particular display data 213 entry pointed to by display data entry register 337 is read from FIFO 205. Accordingly, the next FIFO write signal 209 is issued to memory controller 203. Thus, memory controller 203 obtains the next portion of display data 213 from local memory 231 and writes the display data into the now freed entries in FIFO 205.

At $t_4$, the first display data 213 entry associated with the $t_3$ FIFO write signal 209 is read from FIFO 205.

Similarly, $t_5$ represents the time at which the particular display data 213 entry pointed to by display data entry register 337 is read from FIFO 205, thus resulting in the next FIFO write signal 209 to be issued to memory controller 203.

Finally, $t_6$ represents the time at which the first display data entry associated with the $t_5$ write signal 209 is read from FIFO 205.

The process in timeline 401 continues until all display data 213 has been output to output display 215 at $t_N$.

As shown in FIG. 4, the time between $t_2$ and $t_4$ represents the amount of time for one FIFO read cycle. Similarly, the amount of time between $t_4$ and $t_6$ represents the time for another FIFO read cycle. In addition, $t_3$ and $t_5$ represent the time at which FIFO write signals 209 are issued within each respective FIFO read cycle. In accordance with the present invention, $t_3$ and $t_5$ are selected to occur at an optimal time to avoid the occurrence of overflow and underflow conditions in FIFO 205.

To accommodate the possibility of varying system clock 217 and video clock frequencies, the self-throttling nature of the present invention selectively shifts $t_3$ and $t_5$ to an optimal time in the respective FIFO read cycles to minimize the occurrences of FIFO underflow and overflow conditions. That is, $t_3$ and $t_5$ are shifted to the left, or earlier in their respective FIFO read cycles, in response to the occurrences of underflow conditions in FIFO 205. Conversely, $t_3$ and $t_5$ are shifted to the right, or later in their respective FIFO read cycles, in response to the occurrence of overflow conditions in FIFO 205. The times $t_3$ and $t_5$ are shifted to the left and/or right accordingly by the present invention until an optimal time is set.

Figure 5:
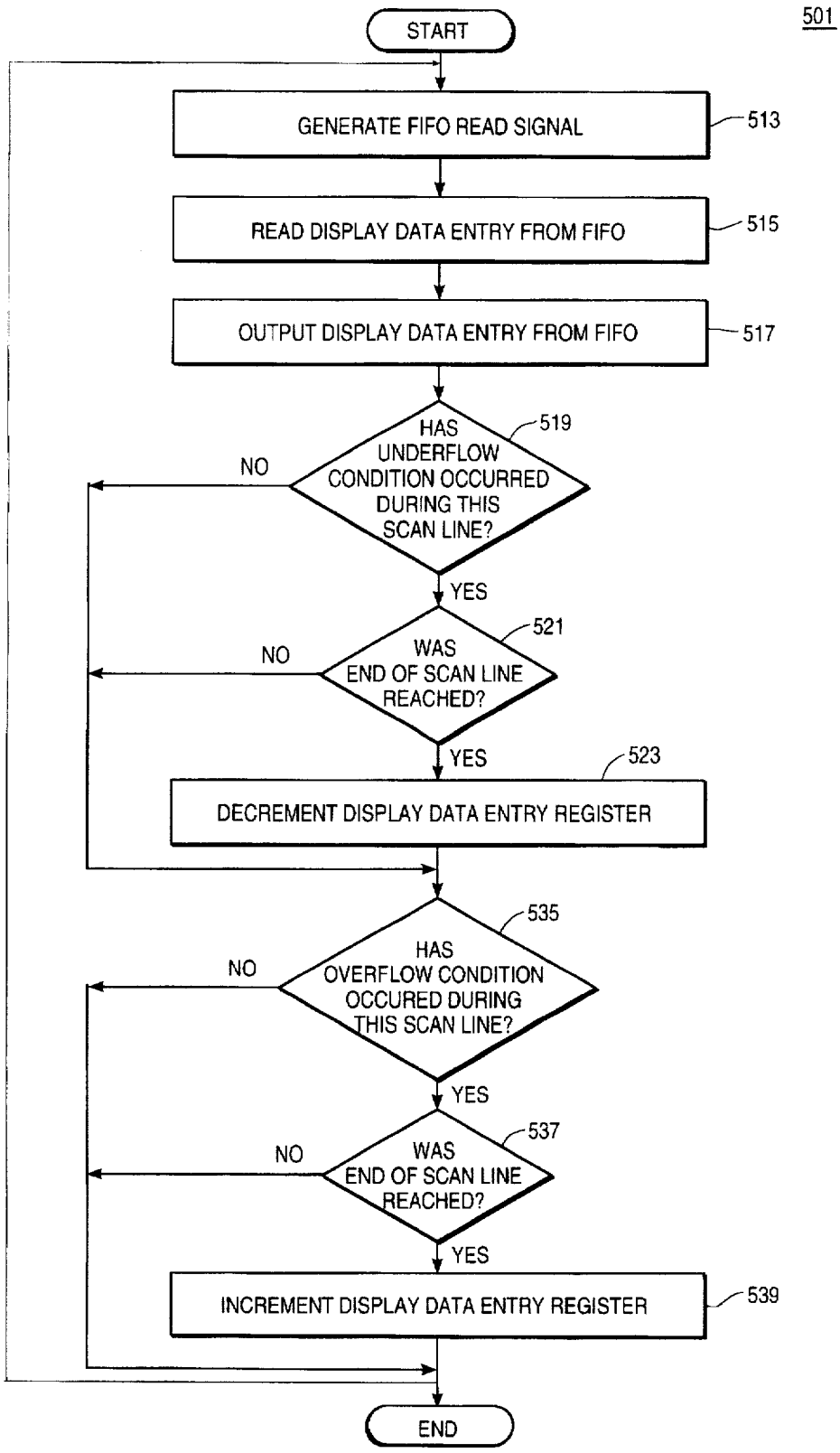
FIG. 5 is a flow diagram representing an exemplary process in accordance with the teachings of the present invention.

FIG. 5 shows a flow diagram 501 representing the processing steps of one embodiment of the present invention. It is assumed that display data exits in local memory and that the present invention continuously reads the display data from the local memory and transfers the display data to the output display. As shown in block 513, a FIFO read signal is generated. Afterwards, a display data entry is read from the FIFO as shown in block 515. That display data entry is then output from the FIFO. Next, it is determined whether or not an underflow condition has occurred during the particular scan line being drawn on the screen. As is well known in the art, output displays include a number of scan lines. In the present embodiment, the display data entry register is not incremented or decremented until the end of the scan line is reached. Therefore, as shown in block 519, if no underflow condition has occurred, processing then proceeds to block 535. If, on the other hand, there was an overflow condition during this scan line, and the end of the end of the scan line was reached as indicated in block 521, the display data entry register is decremented as shown in block 523.

Next, as indicated in block 535, it is determined whether an overflow condition has occurred during this particular scan line. If so, and if the end of the scan line was reached, as indicated in block 537, the display data entry register is incremented as indicated in block 539.

Afterwards, processing proceeds back to processing block 513 and another read signal is generated. The process always repeats as shown to provide the continuous transfer of display data from local memory to the output display 215.

Therefore, an adaptive self-throttling video FIFO is described. The video FIFO described herein features a programmable register which provides optimal coordination of when FIFO write signals are issued in relation to a FIFO read cycle. With the present invention the occurrences of undesirable FIFO overflow and underflow conditions are minimized after an initialization period. With the present invention, the video FIFO need not be unnecessarily large to reduce the occurrences of such overflow and underflow conditions. Furthermore, the present invention is adaptive to computer systems having variable or unknown combinations of system clock and video clock. Therefore, the present invention provides a flexible graphics computer system at reduced cost.

In the foregoing detailed description, an apparatus and method for writing display data to and reading display data from a FIFO is described. The apparatus and the method of the present invention has been described with reference to specific exemplary embodiments thereof. It will, however, be evident that various modifications and changes may be made without departing from the broader spirit and scope of the present invention. The present specification and drawings are accordingly to be regarded as illustrative rather than restrictive.

What is claimed is:

1. A device for writing and reading display data to and from a first-in-first-out memory (FIFO), the device comprising:

a memory controller coupled to the FIFO, the memory controller configured to write a portion of the display data to the FIFO in response to a FIFO write signal;

an output display controller coupled to the FIFO and the memory controller, the output display controller configured to generate the FIFO write signal to the memory controller in response to a display data entry being read from the FIFO;

a programmable memory circuit configured to store a display data entry value indicating the display data entry to be read from the FIFO;

wherein the FIFO is configured to generate an underflow signal when an underflow condition occurs, wherein the FIFO is further configured to generate an overflow signal when an overflow condition occurs, the output display controller coupled to receive the underflow signal and the overflow signal;

wherein the display data entry value is incremented in response to the overflow signal.

2. The device described in claim 1 further comprising a counter circuit configured to indicate a current display data entry value corresponding with a current display data entry in the FIFO being read.

3. The device described in claim 2 wherein the output display controller generates the FIFO write signal in further response to the current display data entry value.

4. The device described in claim 1 wherein the programmable memory circuit is a first register.

5. The device described in claim 4 wherein the counter circuit is a second register.

6. The device described in claim 1 wherein memory controller loads the FIFO with the portion of the data under control of a first clock signal and the display data are transferred out of the FIFO under control of a second clock signal.

7. The device described in claim 6 wherein the first and second clock signals have variable clock frequencies.

8. The device described in claim 7 wherein the first clock signal is a system clock signal and the second clock signal is a video clock signal.

9. The device described in claim 1 further comprising a memory coupled to the memory controller, the memory controller supplying the display data from the memory.

10. The device described in claim 1 further comprising an output display, wherein the display data are transferred out of the FIFO to the output display in response to the FIFO read signal.

11. A device for writing and reading display data to and from a first-in-first-out memory (FIFO), the device comprising:

a memory controller coupled to the FIFO, the memory controller configured to write a portion of the display data to the FIFO in response to a FIFO write signal;

an output display controller coupled to the FIFO and the memory controller, the output display controller configured to generate the FIFO write signal to the memory controller in response to a display data entry being read from the FIFO;

a programmable memory circuit configured to store a display data entry value indicating the display data entry to be read from the FIFO;

wherein the FIFO is configured to generate an underflow signal when an underflow condition occurs, wherein the FIFO is further configured to generate an overflow signal when an overflow condition occurs, the output display controller coupled to receive the underflow signal and the overflow signal;

wherein the display data entry value is decremented in response to the underflow signal.

12. A method for writing and reading display data to and from a first-in-first-out memory (FIFO), the method comprising the steps of:

storing a display data entry value indicating a display data entry to be read from the FIFO in a programmable memory circuit;

writing a portion of the display data into the FIFO with a memory controller in response to a FIFO write signal from an output display controller;

reading sequentially each one of the plurality display data entries from the FIFO in response to a FIFO read signal from the output display controller;

generating the FIFO write signal in response to the display data entry being read from the FIFO;

adjusting the display data entry value to reduce a possibility of an overflow condition and an underflow condition from occurring in the FIFO after an initial stabilization period.

13. The method described in claim 12 wherein the adjusting step comprises the steps of:

generating an overflow signal with the FIFO in response to an overflow condition occurring in the FIFO;

incrementing the display data entry value in response to the overflow signal;

generating an underflow signal with the FIFO in response to an underflow condition occurring in the FIFO; and decrementing the display data entry value in response to the underflow signal.

14. The method described in claim 13 wherein the incrementing step is performed after an end of scan line display data entry is read from the FIFO.

15. The method described in claim 14 wherein the first and second clock signals have variable clock frequencies.

16. The method described in claim 15 wherein the first clock signal is a system clock signal and the second clock signal is a video clock signal.

17. The method described in claim 13 wherein the decrementing step is performed after an end of scan line display data entry is read from the FIFO.

18. The method described in claim 12 wherein the memory controller receives the portion of the display data under control of a first clock signal, and the display data are sequentially read from the FIFO under control of a second clock signal.

19. The method described in claim 12 wherein the memory controller receives the portion of the display data from a memory.

20. The method described in claim 12 wherein the display data sequentially read from the FIFO are output to an output display.

21. The method described in claim 12 wherein the programmable memory circuit is a first register.

22. A computer system comprising:

a central processing unit (CPU);

a system memory coupled to the CPU;

a bus coupled to the CPU; and a graphics subsystem coupled to the bus generating and displaying display data on an output display, the graphics subsystem comprising:

the display data stored in a local memory;

a first-in-first-out memory (FIFO);

a memory controller coupled to the local memory and the FIFO, the memory controller configured to write a portion of the display data into the FIFO in response to a FIFO write signal;

an output display controller coupled to the FIFO and the memory controller, the output display controller configured to generate the FIFO write signal in response to a display data entry being read from the FIFO;

a video output circuit coupled to receive the display data from the FIFO in response to a FIFO read signal, the video output circuit outputting the display data to the output display; and a programmable memory circuit configured to store a display data entry value indicating the display data entry to be read from the FIFO;

wherein the FIFO generates an overflow signal when an overflow condition occurs in the FIFO, wherein the FIFO generates an underflow signal when an underflow condition occurs in the FIFO;

wherein the display data entry to be read is incremented to indicate a next sequential display data entry to be read from the FIFO in response to the overflow signal.

23. The computer system described in claim 22 wherein the programmable memory circuit is a register in the output display controller.

24. The computer system described in claim 22 wherein the memory controller writes the portion of the display data into the FIFO under control of a first clock signal, wherein the display data are sequentially read from the FIFO under control of a second clock signal.

25. The computer system described in claim 24 wherein the first and second clock signals have variable clock frequencies.

26. The computer system described in claim 25 wherein the first clock signal is a system clock signal and the second clock signal is a video clock signal.

27. A computer system comprising:

a central processing unit (CPU);

a system memory coupled to the CPU;

a bus coupled to the CPU; and a graphics subsystem coupled to the bus generating and displaying display data on an output display, the graphics subsystem comprising:

the display data stored in a local memory;

a first-in-first-out memory (FIFO);

a memory controller coupled to the local memory and the FIFO, the memory controller configured to write a portion of the display data into the FIFO in response to a FIFO write signal;

an output display controller coupled to the FIFO and the memory controller, the output display controller configured to generate the FIFO write signal in response to a display data entry being read from the FIFO;

a video output circuit coupled to receive the display data from the FIFO in response to a FIFO read signal, the video output circuit outputting the display data to the output display; and a programmable memory circuit configured to store a display data entry value indicating the display data entry to be read from the FIFO;

wherein the FIFO generates an overflow signal when an overflow condition occurs in the FIFO, wherein the FIFO generates an underflow signal when an underflow condition occurs in the FIFO;

wherein the display data entry to be read is decremented to indicate a previous sequential display data entry to be read from the FIFO in response to the underflow signal.

* * * * *